US005390636A

United States Patent [19]

Baylor et al.

[11] Patent Number: 5,390,636

[45] Date of Patent: Feb. 21, 1995

[54] COOLANT TRANSFER APPARATUS AND METHOD, FOR ENGINE/RADIATOR COOLING SYSTEM

[75] Inventors: James L. Baylor, Fontana; Russell A. Lindquist, Covina; Michael J. Camacho, San Dimas, all of Calif.

[73] Assignee: Wynn Oil Company, Azusa, Calif.

[21] Appl. No.: 195,098

[22] Filed: Feb. 14, 1994

[51] Int. Cl.[6] ..... F02B 77/00

[52] U.S. Cl. ..... 123/198A; 134/22.12; 134/169 A

[58] Field of Search ..... 222/64, 67, 399; 134/169 A, 22.12; 123/198 A; 137/386, 413; 417/120, 126, 129, 130

[56] References Cited

U.S. PATENT DOCUMENTS

| | | |
|---|---|---|
| 1,030,931 | 7/1912 | Silver . |
| 1,451,157 | 4/1923 | Gerbig . |
| 1,582,300 | 4/1926 | Otis . |
| 1,701,824 | 2/1929 | Robinson . |
| 1,742,281 | 1/1930 | Rundlett . |
| 1,871,340 | 8/1932 | Pielstick . |
| 2,187,413 | 1/1940 | Boezi et al. . |
| 2,188,245 | 1/1940 | Middleton . |
| 2,201,774 | 5/1940 | Hofele . |
| 2,281,695 | 5/1942 | James et al. . |
| 2,366,073 | 12/1944 | Vallerie . |
| 2,632,719 | 3/1953 | Tankersley . |
| 2,644,440 | 7/1953 | Bailey, Sr. . |
| 2,888,913 | 6/1959 | Emmett et al. . |
| 3,002,909 | 10/1961 | Heidt . |
| 3,094,131 | 6/1963 | Williams . |
| 3,106,194 | 10/1963 | Cantwell, Jr. et al. . |
| 3,115,145 | 12/1963 | Monteath, Jr. . |
| 3,148,670 | 9/1964 | Fiedler et al. . |
| 3,173,408 | 3/1965 | Brenneman . |
| 3,180,759 | 4/1965 | Falk . |
| 3,211,377 | 10/1965 | Brenner . |
| 3,224,684 | 12/1965 | Roosa . |
| 3,318,096 | 5/1967 | Webb . |
| 3,338,564 | 8/1967 | Roeder . |
| 3,403,695 | 10/1968 | Hopkins . |
| 3,409,218 | 11/1968 | Moyer . |
| 3,540,528 | 11/1970 | Moon . |
| 3,540,588 | 11/1970 | Estabrook . |
| 3,589,388 | 6/1971 | Hameline, Jr. . |
| 3,752,398 | 8/1973 | Svensson . |
| 3,776,384 | 12/1973 | Offer . |
| 3,954,611 | 5/1976 | Reedy . |
| 3,960,208 | 6/1976 | Anthony et al. . |
| 3,961,482 | 6/1976 | Jamaux . |
| 4,015,613 | 4/1977 | Papworth . |
| 4,029,115 | 6/1977 | Wheeler . |
| 4,052,308 | 10/1977 | Higgs . |
| 4,054,150 | 10/1977 | Thomas . |
| 4,059,123 | 11/1977 | Bartos et al. . |
| 4,061,504 | 12/1977 | Zall et al. . |
| 4,082,565 | 4/1978 | Sjolander . |
| 4,083,399 | 4/1978 | Babish et al. . |
| 4,086,930 | 5/1978 | Hiss . |
| 4,109,703 | 8/1978 | Babish et al. . |
| 4,127,160 | 11/1978 | Joffe . |
| 4,128,140 | 12/1978 | Riches . |
| 4,161,160 | 7/1979 | Hicks et al. . |
| 4,161,979 | 7/1979 | Stearns . |

(List continued on next page.)

FOREIGN PATENT DOCUMENTS

| | | |
|---|---|---|
| 1028634 | 11/1950 | France . |
| 1046597 | 5/1961 | France . |
| 1362962 | 4/1964 | France . |
| 2086488 | 5/1982 | United Kingdom . |

*Primary Examiner*—Noah P. Kamen
*Attorney, Agent, or Firm*—William W. Haefliger

[57] ABSTRACT

An apparatus to supply liquid coolant, to and to transfer coolant from, an engine and radiator coolant system, comprising a supply tank having a coolant fill inlet, which is closable, and a coolant delivery outlet to deliver coolant via a hose to the engine and radiator coolant system; an air pressurization inlet to the tank to receive compressed air that forces coolant from the tank via the outlet; and structure responsive to a predetermined coolant flow from the tank for relieving pressurization of the tank, whereby coolant flow is then interrupted.

17 Claims, 4 Drawing Sheets

U.S. PATENT DOCUMENTS 4,167,193 9/1979 Magnus et al. .
4,176,708 12/1979 Joffe .
4,190,346 2/1980 Hutson et al. .
4,197,140 4/1980 Swan .
4,209,063 6/1980 Babish et al. .
4,276,914 7/1981 Albertson .
4,290,392 9/1981 Dissmore .
4,293,031 10/1981 Babish et al. .
4,331,121 5/1982 Stokes .
4,338,959 7/1982 Krueger et al. .
4,343,353 8/1982 Tsopelas .
4,346,689 8/1982 Neely .
4,366,069 12/1982 Dudrey et al. .
4,390,049 6/1983 Albertson .
4,439,110 3/1984 Massaux ..... 417/129
4,516,547 5/1985 Williams .
4,520,773 6/1985 Koslow .
4,553,587 11/1985 Traylor .
4,597,416 7/1986 Scales .
4,606,311 8/1986 Reyes et al. .
4,606,363 8/1986 Scales .
4,671,230 6/1987 Turnipseed .
4,784,170 11/1988 Romanelli et al. .
4,787,348 11/1988 Taylor .
4,790,882 12/1988 Barres .
4,791,890 12/1988 Miles et al. .
4,793,403 12/1988 Vataru et al. .
4,809,769 3/1989 Vataru et al. .
4,877,043 10/1989 Carmichael et al. .
4,899,807 2/1990 Vataru et al. .
4,901,786 2/1990 Vataru et al. .
4,949,682 8/1990 Klein .
4,989,561 2/1991 Hein et al. .
5,015,301 5/1991 Baylor et al. .
5,021,152 6/1991 Filowitz et al. .
5,078,866 1/1992 Filowitz et al. .
5,097,806 3/1992 Vataru et al. .

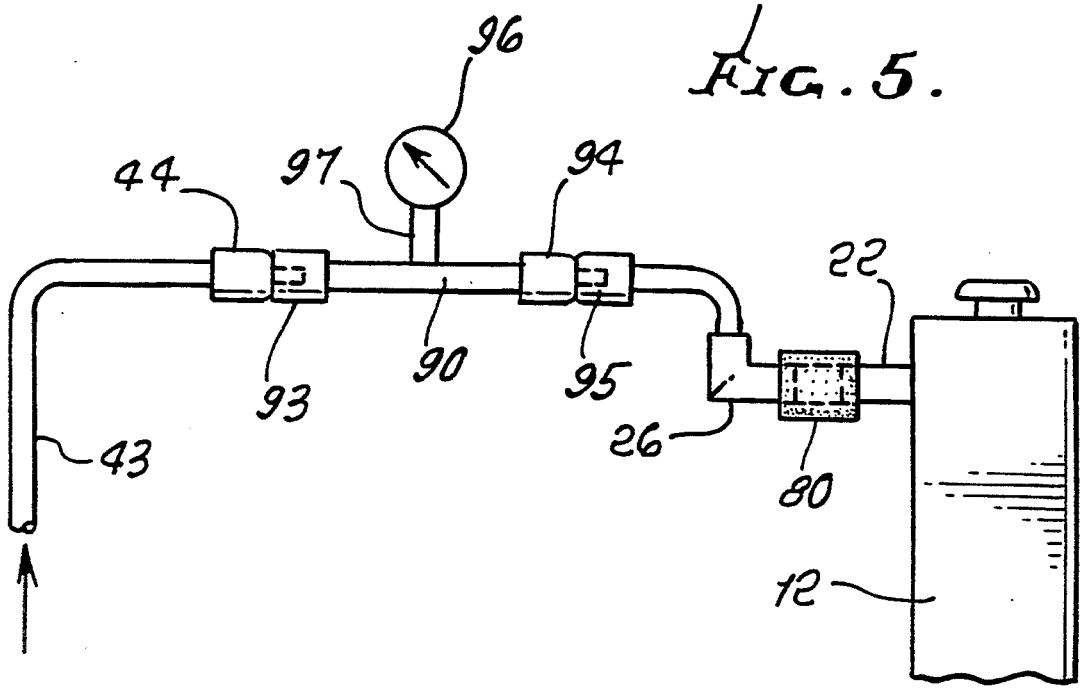
FIG. 5.
FIG. 6.
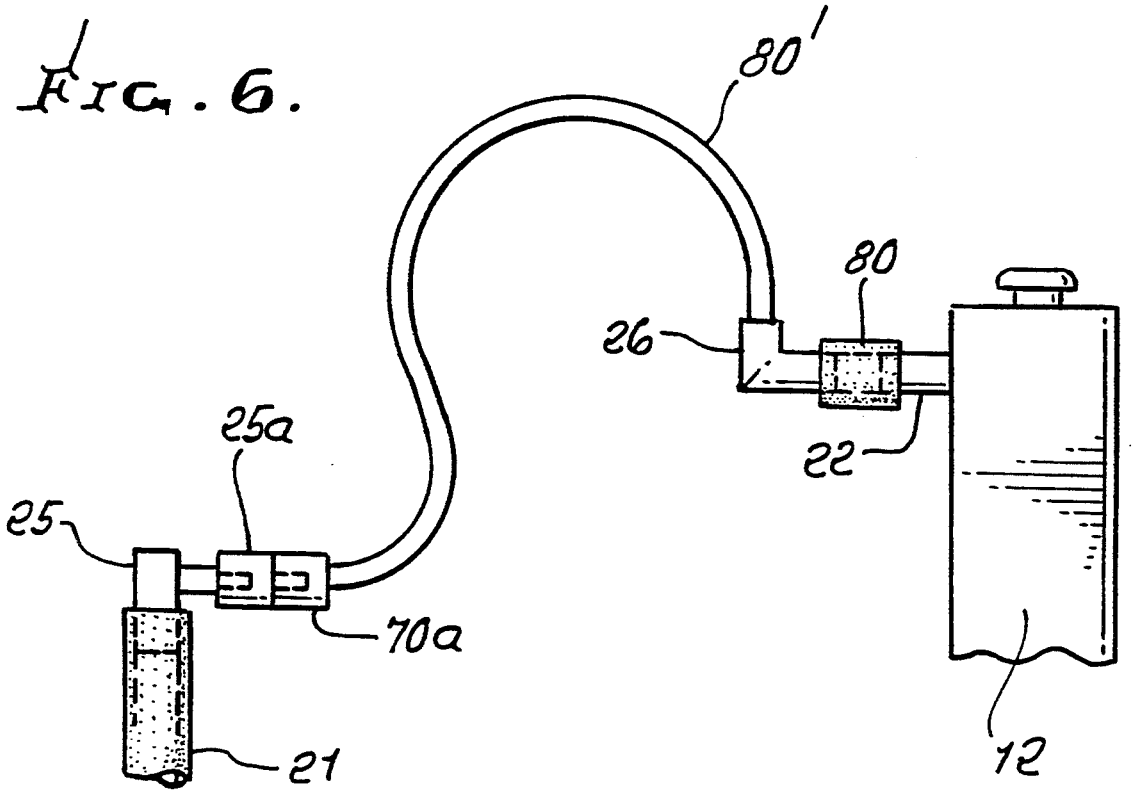

COOLANT TRANSFER APPARATUS AND METHOD, FOR ENGINE/RADIATOR COOLING SYSTEM

BACKGROUND OF THE INVENTION

This invention relates generally to flushing of internal combustion engine liquid cooling systems; more particularly, it concerns coolant transfer apparatus and method to achieve efficient removal of scale and rust.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack.

Accordingly, there is need for efficient engine cooling system flushing methods and apparatus.

SUMMARY OF THE INVENTION

It is a major object of the present invention to provide flushing procedure and apparatus characterized as overcoming the problems discussed above and the disadvantages of prior flushing techniques. Basically, the invention employs the force of controlled pressurized air to drive fresh coolant into flushing internal combustion engine liquid cooling systems, including radiator and engine block coolant passages, displacing and removing used coolant in such passages. Hookup adapters are provided for this purpose. The fundamental apparatus employs the following:

a) a supply tank having a coolant fill inlet, which is closable, and a coolant delivery outlet to deliver coolant via a hose to the engine and radiator coolant system, b) an air pressurization inlet to the tank to receive compressed air that forces coolant from the tank via the outlet, c) and means responsive to a predetermined coolant flow from the tank for relieving pressurization of the tank, whereby coolant flow is then interrupted.

As will appear, the means to relieve air pressurization in the supply tank advantageously includes a float in the tank, and a float-controlled device to interrupt air pressurization of the tank interior release air pressure from the tank.

It is an object of the invention to provide a control panel and a carrier or console carrying the panel and tank, and a selector on the panel and a selector valve means connected with the selector for controllably routing flow of coolant from the tank outlet to the coolant system. That panel and carrier may be of retrofit type, whereby the invention is applicable to an existing panel and carrier.

A further object of this invention is the provision of a selector valve at the control panel and having operative connection with an air pressurization line leading to the tank, whereby controlled flow of the fresh coolant from the supply tank to the coolant system may be initiated and terminated.

Yet another object is the provision of a first adapter connectible to a port at the radiator when a coolant line is disconnected from the port, the first adapter closing the port, and also having a first side inlet for connection to the hose, thereby to direct flow of fresh coolant from the tank to the radiator via the first side port; and a second adapter connectible to the disconnected coolant line for closing that line, the second adapter having a second side inlet for connection to a hose to receive used coolant from the coolant system for discharge to a collection receptacle.

The basic method of the invention includes the steps:

a) providing a coolant supply tank having a coolant delivery outlet, b) communicating the outlet to the radiator via an inlet port to the radiator, c) supplying compressed air to the tank to pressurize the tank and drive coolant in the tank to the radiator via the tank outlet and the radiator inlet, thereby to displace used coolant from the coolant system, d) and relieving the pressurization of the tank in response to predetermined coolant flow from the tank, whereby coolant flow to the radiator is interrupted before compressed air enters the coolant system.

Additional steps include providing a control panel, a carrier carrying the panel and tank, and providing a selector on the panel and selector valve means connected with the selector for controllably routing flow of coolant from the tank outlet to the coolant system; providing a first adapter and connecting same to a port at the radiator when a coolant system line is disconnected from the port, and also having a first side port for connection to the hose, thereby to direct flow of coolant from the tank to the radiator, via the first side port; and providing a second adapter and connecting same to the disconnected coolant system line for closing the line, the second adapter having a second side inlet for connection to a hose to receive used coolant from the coolant system for discharge to a collection receptacle.

Yet another step of the method includes preliminarily connecting a jumper hose to the adapters via the first and second side ports to preliminarily allow passage of coolant system coolant during engine operation and warm-up; and connecting a pressure gauge in communication with the jumper hose, and observing coolant system fluid pressure, whereby a low pressure may indicate a system leak. Further, the method may include the step of collecting used coolant fluid displaced from the coolant system, and treating the fluid to precipitate metal ions therefrom.

These and other objects and advantages of the invention, as well as the details of an illustrative embodiment, will be more fully understood from the following specification and drawings, in which:

DRAWING DESCRIPTION

FIG. 5 is a schematic showing of one mode of operation of apparatus used in conjunction with flushing;

FIG. 6 is a schematic showing another mode of operation of apparatus used in conjunction with flushing;

DETAILED DESCRIPTION

Figure 1:
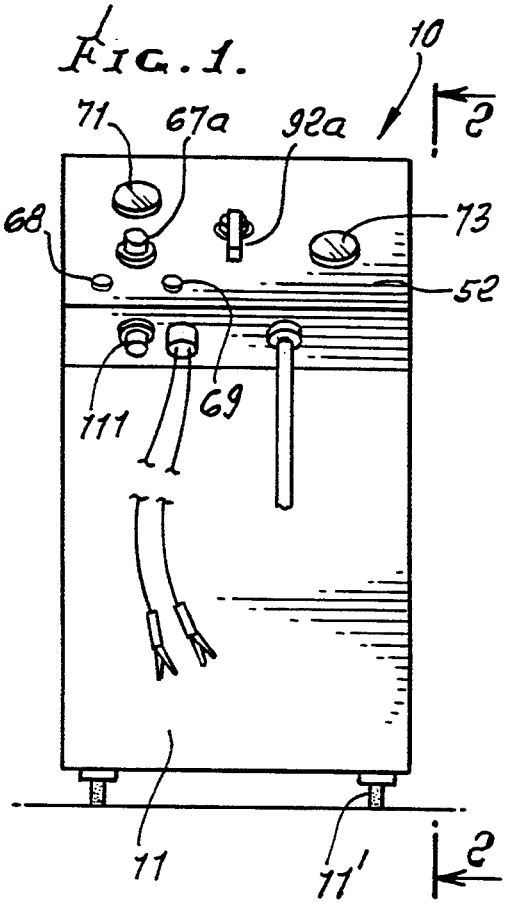
FIG. 1 is a front elevation showing a flush treatment console or stand, that is movable and usable for controllably flushing the cooling system of a vehicle.
Figure 2:
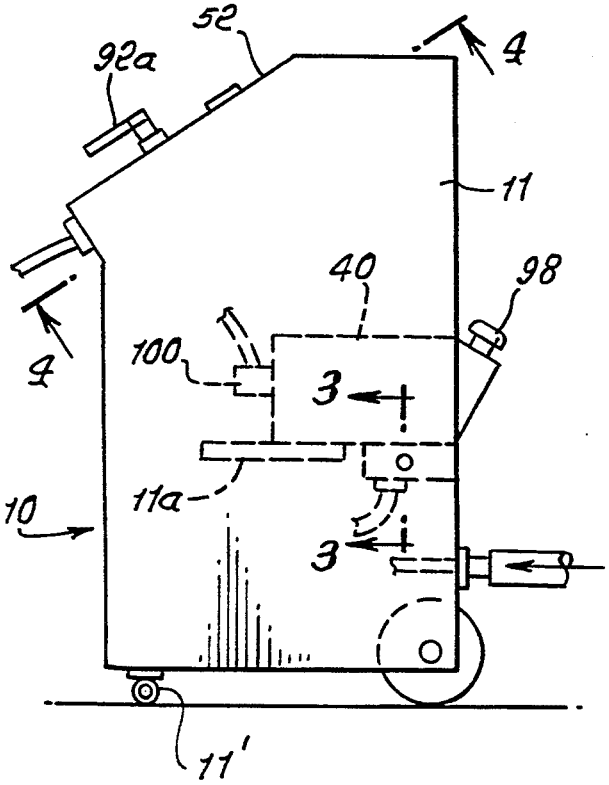
FIG. 2 is a side elevation taken on lines 2—2 of FIG. 1.
Figures 7, 7A:
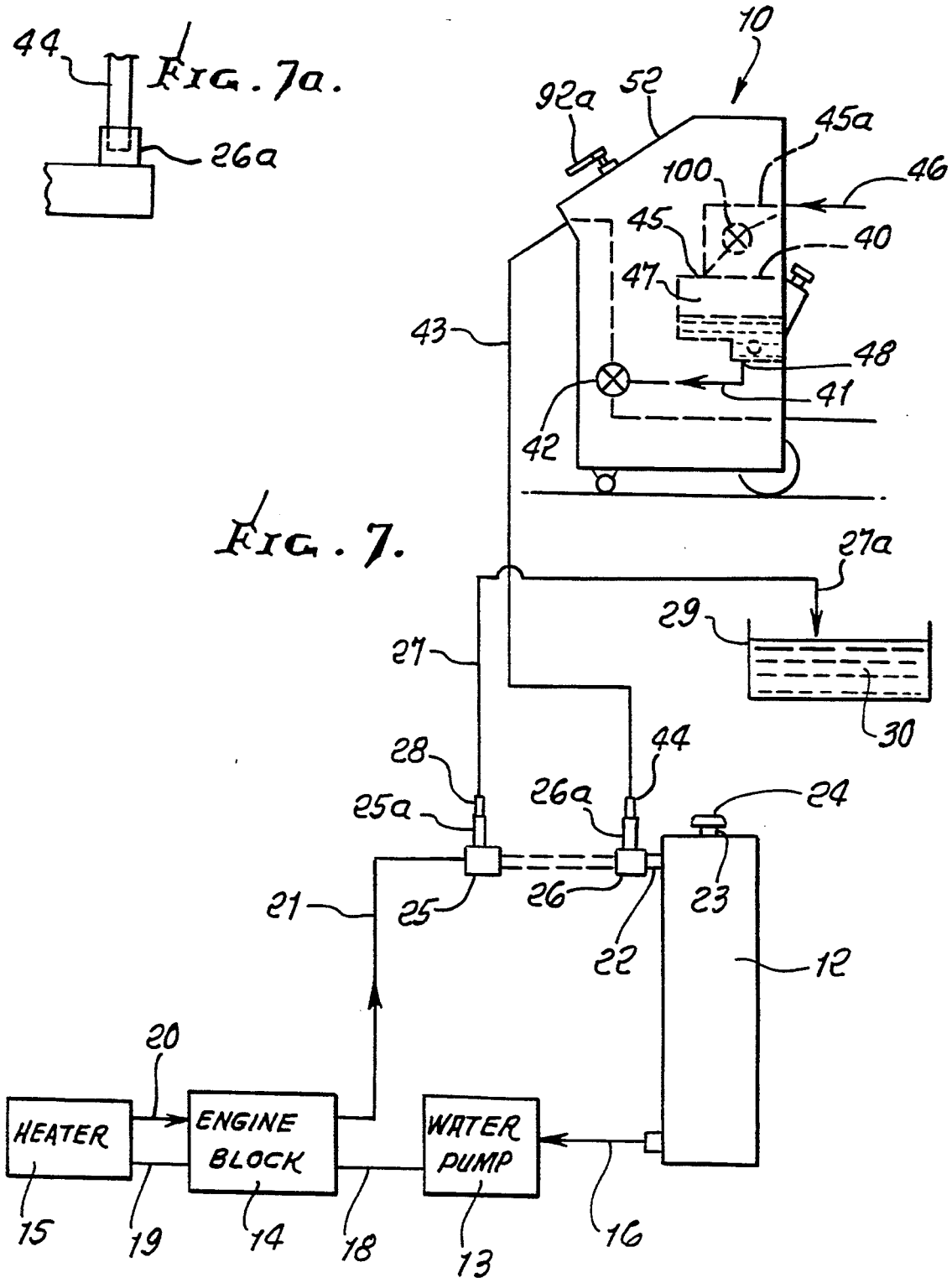
FIG. 7 is a schematic showing of yet another mode of operation of apparatus used in conjunction with flushing and employing the FIG. 1 stand.
FIG. 7*a* shows a push-in connection.

Referring to FIGS. 1, 2 and 7, a console or service cart 10 has wheels 11 by which it is movable about, in a servicing area, as in a filling station garage. It includes a housing 11, and an internal frame support 11*a* for a tank 40 to contain liquid coolant to be transferred into the cooling system of a vehicle. See for example the vehicle radiator 12, water pump 13, engine block 14, and heater 15. The latter components contain coolant passages, as is well known, and coolant may be caused to flow from the radiator via line 16, to the water pump 13, then via duct 18 to the block passages, then via line 19 to the heater passages, then via line 20 back to block passages, then via return line or hose 21 normally connected to the radiator side inlet 22. Coolant is normally filled into the radiator via top inlet 23 from which a cap 24 is removed.

In FIG. 7, the line 21 is disconnected from inlet 22. An adapter 25 is connected to the end of that line, and an adapter 26 is connected to the side inlet tube, at 22. The adapters have side inlet ports (as may be defined by short tubes on the adapter bodies) 25*a* and 26*a*, to which connections may be made in accordance with the fill operating mode of the present invention. In this regard, note that a hose or line 27 is shown connected at 28 with port 25*a*, the opposite end of that line shown as openly discharging at 27*a* to receptacle 29 into which used coolant 30 from the vehicle coolant system is to be discharged or flushed.

In accordance with the fill operating mode, the service cart is employed to effect flushing of used coolant, as referred to. Note that in FIGS. 1, 2 and 7, supply tank 40 is connected via line 41 in the cart 10, and line 43 extending outside the cart, and to the port 26*a* of adapter 26, as via a connector 44. Both connections 28 and 44 may be quick, tubular, "push in" connections of the type described in U.S. Pat. No. 5,015,301, incorporated herein by reference. Thus, when connection 28 is made-up (pushed together as into or onto port 25*a*), an internal shut-off valve is opened, so that flushing liquid may pass. The same is true of the connection at 44, and pass liquid from line 43 to the radiator. FIG. 7*a* represents such a connection.

Supply tank 40 has an inlet 45 for compressed air supplied at 46. Such air pressure in the tank upper interior at 47 forces liquid downwardly toward tank outlet 48 connected to line 41, through check valve 42 to line 43 and to the radiator. Thus, fresh coolant 30*a* is forced from tank 40 into the vehicle coolant system to displace used coolant 30, which discharges at 27*a*, as referred to.

Figure 4:
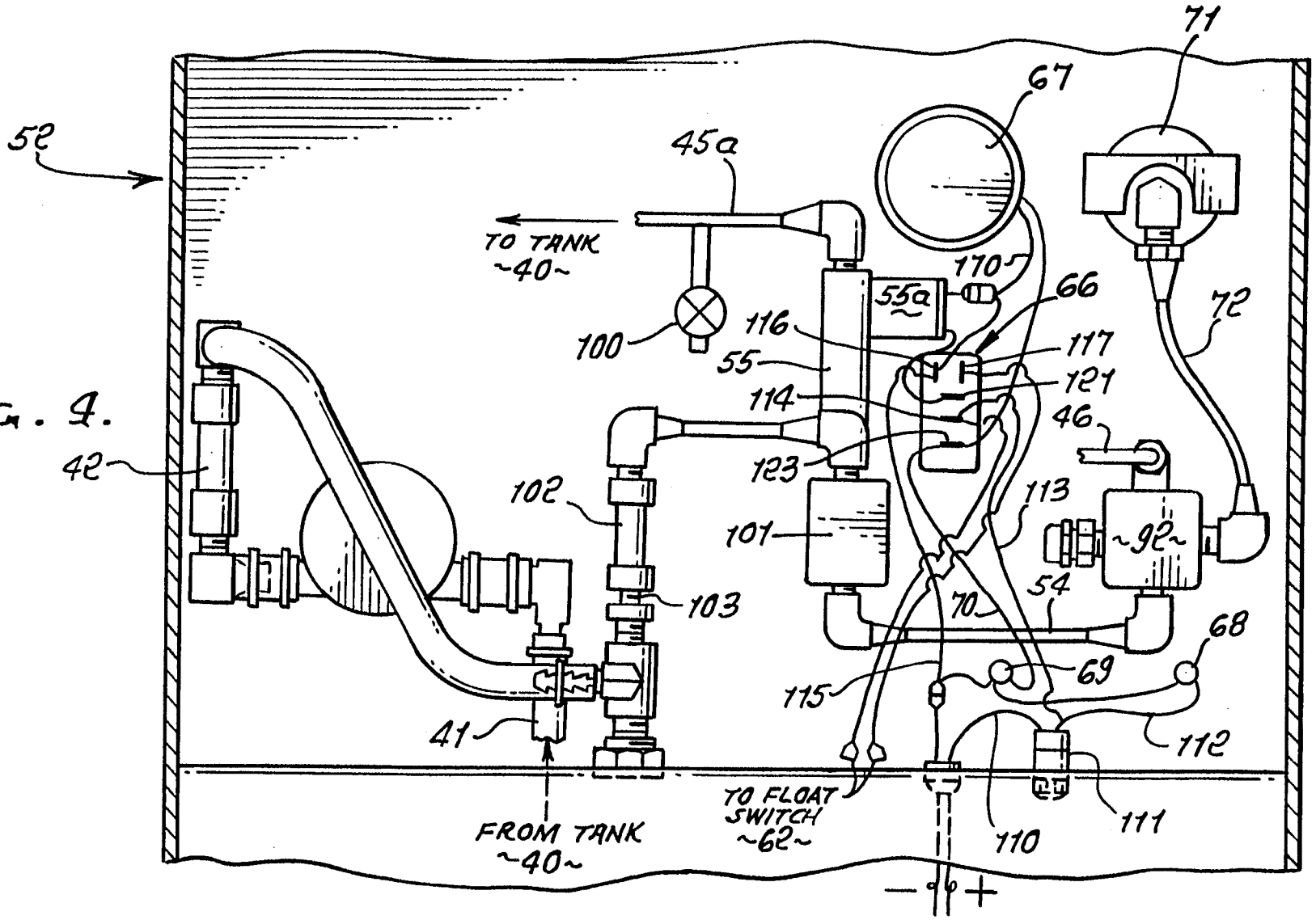
FIG. 4 is a section taken on lines 4—4 of FIG. 2.

Referring to FIG. 4, showing controls at the inner side of cart panel 52, compressed air flows from supply hose 46 to air pressure regulator 92. When the control knob 67*a* of 92 (see FIG. 1) is rotated clockwise to open position, compressed air flows through 92 to line 54 to a four-way valve 101. When that valve is opened via a handle 92*a* on the control panel, compressed air flows through shut-off valve 55 to inlet line 45*a* connected to inlet 45 at supply tank 40. Valve 55 is closed in response to predetermined coolant level drop in tank 40, thereby relieving air pressurization of the tank, whereby coolant flow is interrupted. This prevents ingress of compressed air into line 43 leading to the vehicle coolant system.

Figure 3:
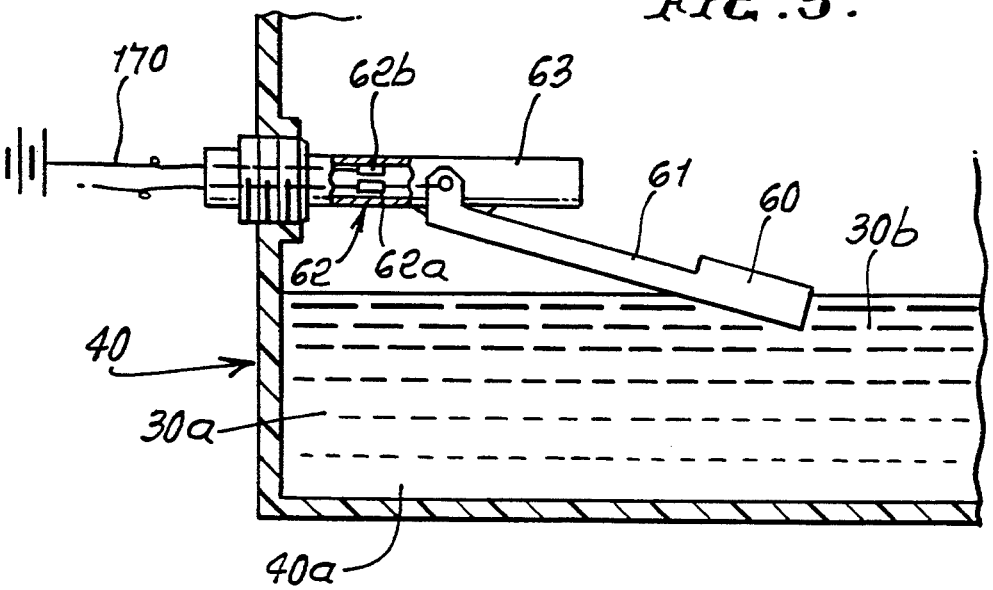
FIG. 3 is an enlarged section taken in elevation on lines 3—3 of FIG. 2.

FIGS. 3 and 4 show one form of such air flow interrupting control means. It includes a float 60 in tank 40, as for example in a lowermost section 40*a* thereof, the float arm 61 connected to a switch 62 in housing 63. When the supply coolant level 30*b* drops to a predetermined low level, switch contact 62*a* rises to engage contact 62*b*, sending a signal to solenoid actuator 55*a* for valve 55, and effecting closing of that valve, thereby interrupting air pressure supply to line 45*a*. Air pressure in tank 40 will be vented via air exhaust valve 100 which discharges to the exterior when activated. See FIG. 2.

Compressed air flow can be interrupted in line 45*a* by operation of a relay 66. The latter is operated by closing of switch 62, energized by an exterior 12 volt DC power source. Light 68 is energized by that power source, in ON condition. Light 69 on the panel is connected to electrical circuitry, such as wire 70 extending to alarm 67, and wire 170 extending to solenoid 55*a*. An air pressure gauge 71 is connected via line 72 with valve 92, to indicate supply air pressure. A supply coolant flow gauge 73 (see FIG. 1) is connected in series with line 41 extending to line 43. Gauge 73 may consist of a spinner which visibly spins when flow passes in line 41. FIG. 4 also shows a check valve 102 in a line 103.

When power is applied via a battery, current is supplied via line 110, fuse 111 and line 112 to light 68, turning 68 ON. Positive lead 113 extends to the contact 114 of relay 66. Negative lead 115 extends to relay contact 116.

When liquid level 30*b* drops (see FIG. 3) and switch 62 is operated, a signal is transmitted to contact 117 of the relay 66. This energizes the relay coil and the relay fulcrum moves to disconnect contacts 121 and 114, and to connect contacts 114 and 123. Solenoid 55*a* is then operated to close valve 55, stopping air flow to the tank, and also causing the tank exhaust valve 100 to open, releasing air pressure in the tank.

FIG. 6 shows a preliminary mode of operation wherein the radiator inlet is connected with the engine coolant hose 21, and the engine run, to cause coolant flow in the system after a thermostat opens. Such flow is visibly indicated in a transparent connector hose 80'. One end of the latter is connected to radiator side inlet 22 via adapter 26 and short elastomeric tube 80. The other end of hose 80' connects to engine hose 21 via adapter 25, and quick connection, mating tubular elements 25*a* and 70*a*. This step is accomplished prior to carrying out the operation, as in FIG. 7, since it is necessary that supply coolant flow into the vehicle coolant system to displace used coolant therefrom. The supply coolant may have a characteristic color to indicate that the system has been filled with it, when the coolant discharging at 27*a* takes on that color.

FIG. 5 shows how the adapter elements can be used to perform a system pressure test, as for leaks. Note duct 90 connected with adapter 26, as in FIG. 6, and with the hose 43 via quick disconnect elements 25*a* and 93, and quick disconnect elements 94 and 95. (Element 95 may be the same as 70*a* in FIG. 6.) A pressure gauge 96 is connected at 97 with duct 90. Coolant in hose 43 is pressurized as via the console.

More detailed steps of the invention include:

1. Release cooling system pressure using the Wynn's (Wynn Oil Company) Cooling System Pressure Reliever Tool. Remove radiator cap.
2. Remove coolant from overflow tank and top of radiator using the Pressure Reliever Tool.

3. Pinch off upper radiator hose 6" from radiator, using pinch pliers, and remove hose from radiator.
4. Install the correct size Female Upper Radiator Hose Adapter 26 onto the radiator.
5. Install the correct size Male Upper Radiator Hose Adapter 25 into the open end of the radiator hose. Secure adapters with hose clamps. Remove pinch pliers.
6. Add one bottle of Wynn's X-TEND (TM) Power Radiator Flush to radiator and fill radiator with coolant to proper level.
7. Open heater control valve. Install radiator cap.
8. Install Pressure Test Gauge Assembly onto the Female Radiator Hose Adapter. Hook up Outlet Hose to other side of Pressure Test Gauge. See FIG. 5.
9. Hook up shop air line to air fitting at back of flush and fill machine.
10. Turn Air Control clockwise until Main Air Pressure Gauge reads 15 psi.
11. Check for any cooling system leaks.
12. Disconnect Outlet Hose from Pressure Test Gauge. Pressure should hold steady for at least one (1) minute if there are no leaks (includes radiator cap). NOTE: If cooling system has leaks, pressure will decrease. Locate and repair leaks before continuing.
13. Remove Pressure Test Gauge.
14. Hook up Adapter Hose between Radiator Adapters 25 and 26. See FIG. 6.
15. Pinch off overflow hose between radiator cap and coolant overflow tank using pinch pliers.
16. Start engine. Warm up engine until thermostat opens and coolant flows through clear hose between Adapters. Allow engine to keep running for ten (10) minutes while flush chemical cleans.
17. Add new or recycled 50/50 coolant mixture (50% antifreeze/50% water) to tank 40 at back of flush and fill machine to a level in the tank at least equal to the capacity of the cooling system.
18. Install tank cap 98 securely.
19. Place open end of the used Coolant Drain hose into the Used Coolant Container 29.
20. Hook up electrical leads to vehicle's battery (Red to +, Black to −). Power light will come on.
21. Turn Main Control to ON.
22. Disconnect hose 80 from between Radiator Hose Adapters 25 and 26 and connect Outlet Hose 43 to Female Radiator Hose Adapter, connect Used Coolant Drain Hose 27 to Male Radiator Adapter 25. See FIG. 7.
23. Process until Process Complete Light comes on and beeper sounds, disconnect Drain Hose and Outlet Hose. Reconnect hose 80 between Adapters 25 and 26.
24. Turn flush and fill machine off and disconnect battery hook up. Turn engine off. Release cooling system pressure and remove radiator cap.
25. Remove Adapters and reconnect vehicle to normal operating condition. Start engine.
26. When engine is fully warmed up, add Wynn's X-TEND (TM) Radiator Sealant; fill radiator and overflow tank to proper level with 50/50 coolant mixture. Bleed air from cooling system, if needed, and install radiator cap.

Used coolant in receptacle 29 can be renewed or reused as supply coolant in tank 40, by treating the used coolant with Wynn's metal ion precipitation preparations, (NETAMOX and PROTAZYNE), and filtering the treated, used coolant. See also U.S. Pat. Nos. 5,021,152; 4,901,786; and 5,078,866.

I claim:

1. In apparatus to supply liquid coolant, to and to transfer coolant from, an engine and radiator coolant system, the combination comprising a) a supply tank having a coolant fill inlet, which is closable, and a coolant delivery outlet to deliver coolant via a hose to said engine and radiator coolant system, b) an air pressurization inlet to said tank to receive compressed air that forces coolant from the tank via said outlet, and a source of compressed air connected to said inlet, c) and means responsive to a predetermined coolant flow from the tank for relieving pressurization of said tank, whereby coolant flow is then interrupted, d) and wherein said means includes a float located and movable in the tank, for sensing the top level of coolant in the tank, and a float-controlled device to interrupt air pressurization of the tank interior release air pressure from the tank, e) and including a control panel and a carrier carrying said panel and tank, and a selector on the panel and a selector valve means connected with said selector for controllably effecting flow of pressurized coolant from the tank outlet below the float to the coolant system.

2. The combination of claim 1 wherein said selector valve means also has operative connection with an air pressurization line leading to the tank.

3. The combination of claim 1 including a first adapter connectible to a port at the radiator when a coolant system line is disconnected from said port, and said adapter also having a first side port for connection to said hose, thereby to direct flow of coolant from said tank to said radiator, via said first side port.

4. The combination of claim 3 including a second adapter connectible to the disconnected coolant system line for closing said line, said second adapter having a second side inlet for connection to a hose to receive used coolant from said coolant system for discharge to a collection receptacle.

5. The combination of claim 4 including a jumper hose connected to said adapters via said first and second side ports, to preliminarily allow passage of coolant system coolant during engine operation and warm-up.

6. The combination of claim 5 including a pressure gauge in communication with said jumper hose.

7. The combination of claim 5 wherein said jumper hose is transparent.

8. The combination of claim 1 wherein said device includes a shut-off valve to shut off air pressurization of the tank interior, and a pressure release valve to release air pressure from the tank, said valves being float controlled.

9. In the method of supplying liquid coolant to an engine and radiator coolant system, the steps that include a) providing a coolant supply tank having a coolant delivery outlet, b) communicating said outlet to said radiator via an inlet port to the radiator, c) supplying compressed air to said tank to pressurize the tank and drive coolant in the tank to said radiator via the tank outlet and the radiator inlet, thereby to displace used coolant from the coolant system, d) sensing the level of liquid coolant in said tank, and relieving said pressurization of the tank in response to predetermined coolant flow from the tank causing the sensed liquid level to drop to a predetermined low level, whereby coolant flow to the radiator is interrupted before compressed air enters the coolant system, e) and controlling flow from said outlet to the radiator.

10. The method of claim 9 wherein said sensing is effected by providing a float in said tank and a float-controlled device to interrupt air pressurization of the tank interior release air pressure from the tank, and controlling flow of coolant.

11. The method of claim 10 including providing a control panel, a carrier carrying said panel and tank, and providing selector on the panel and selector valve means connected with said selector for controllably routing flow of coolant from the tank outlet to the coolant system.

12. The method of claim 9 including providing a first adapter and connecting same to a port at the radiator when a coolant system line is disconnected from said port, and said adapter also having a first side port for connection to said hose, thereby to direct flow of coolant from said tank to said radiator, via said first side port.

13. The method of claim 12 including providing a second adapter and connecting same to the disconnected coolant system line for closing said line, said second adapter having a second side inlet for connection to a hose to receive used coolant from said coolant system for discharge to a collection receptacle.

14. The method of claim 13 including preliminarily connecting a jumper hose to said adapters via said first and second side ports to preliminarily allow passage of coolant system coolant during engine operation and warm-up.

15. The method of claim 14 including connecting a pressure gauge in communication with said jumper hose, and observing coolant system fluid pressure, whereby a low pressure may indicate a system leak.

16. The method of claim 9 including collecting used coolant fluid displaced from the coolant system, and treating said coolant to precipitate metal ions therefrom.

17. The method of claim 16 including reusing said treated, used coolant by supplying same to said supply tank.

* * * * *